US005863257A

United States Patent [19]

Busnardo

[11] Patent Number: 5,863,257

[45] Date of Patent: Jan. 26, 1999

[54] ADJUSTABLE PUTTER

[76] Inventor: Romolo Buzz Busnardo, 1320 Ruth La., Nampa, Id. 83686

[21] Appl. No.: 838,019

[22] Filed: Apr. 22, 1997

[51] Int. Cl.[6] ..... A63B 53/06

[52] U.S. Cl. ..... 473/246; 473/248; 473/307; 473/251

[58] Field of Search ..... 473/244, 245, 473/246, 247, 248, 251, 305, 306, 307, 313, 314, 340, 325, 288

[56] References Cited

U.S. PATENT DOCUMENTS

| | | | |
|---|---|---|---|
| 1,986,626 | 7/1935 | Young . | |
| 2,644,689 | 7/1953 | Putnam . | |
| 3,211,455 | 10/1965 | Hyden . | |
| 3,430,957 | 3/1969 | Andis . | |
| 3,843,122 | 10/1974 | Florian . | |
| 4,076,254 | 2/1978 | Nygren . | |
| 4,113,249 | 9/1978 | Beery . | |
| 4,121,832 | 10/1978 | Ebbing . | |
| 4,252,262 | 2/1981 | Igarashi . | |
| 4,735,414 | 4/1988 | Williams | 473/248 |
| 4,736,951 | 4/1988 | Grant . | |
| 4,795,158 | 1/1989 | Kuykendall . | |
| 4,815,740 | 3/1989 | Williams | 473/248 |
| 5,407,196 | 4/1995 | Busnardo | 473/307 |
| 5,462,279 | 10/1995 | Culpepper | 473/307 |

*Primary Examiner*—Sebastiano Passaniti
*Attorney, Agent, or Firm*—Frank J. Dykas

[57] ABSTRACT

An adjustable golf putter which has an attachment means which allows the shaft to be removed from the putter head, and allows the angle between the golf club shaft and the golf club putter head to be adjusted. An array of angle selection notches and an angle selection tooth are provided on the first end of the shaft. These angle selection notches correspond to a variety of angles between the shaft and the putter head body. Choice of an angle selection notch positions determines the angle between the putter shaft and the putter head body and holds it at that angle in a positive manner. The putter also has interchangeable face plate assemblies, which provide for changing the mass of the putter head and the loft angle of the striking face.

14 Claims, 4 Drawing Sheets

ADJUSTABLE PUTTER

BACKGROUND OF THE INVENTION

1. Technical Field

This invention relates in general to golf clubs, and more particularly to an adjustable putter in which the angle between the golf club shaft and the golf putter head is adjustable.

2. Background

U.S. Pat. No. 5,407,196, to Romolo Busnardo, inventor of the instant invention, discloses an adjustable golf putter. This putter provides for adjustment of the angle between the golf club shaft and the putter head, as well as the angle of the striking face, and adjustment of the mass of striking face and the putter head body. These adjustments are necessitated by the critical nature of a putter to a golfer's game.

No club in the golfer's ensemble of clubs is used more often than a putter. A typical round of golf involves 18 holes of play. A par round of golf for most courses constitutes 72 strokes. "Regulation" golf usually involves a drive, a second shot on to the green, and two putts. That being the case, 36 strokes in a typical par round of golf will be putts. Many golfers will use the putter even more, depending on the golfer's ability.

The majority of putters on the market follow the conventional wisdom that a putter face needs a positive loft of several degrees. It is believed that loft on a putter is needed to aid roll.

Most putters do, in fact, have several degrees of loft. When a ball is putted, it moves across the green initially by sliding. As the frictional forces of the green cause the spin rate of the ball to increase, the ball eventually stops sliding and begins to spin or roll. It is while the ball is rolling that the putt has the greatest amount of directional stability due primarily to the inertia created by the rolling ball.

Therefore, it would follow that the sooner the ball begins to roll, the greater the control that the player will have over his putt. It is particularly true on very well kept greens. By using a putter having a negative loft, top spin is imparted on the ball when struck, increasing the tendency of the ball to roll rather than slide.

Nevertheless, at times the player would prefer that the putt have several degrees of positive loft, for example, when playing off the fringe or when playing long putts or putts on greens which are not so well kept. In these instances, a few degrees of positive loft may be beneficial for moving the ball nearer the hole.

Accordingly, it would be of benefit to the experienced putter to be able to interchange between a positive loft and a negative loft striking face, depending on course and play conditions. In addition, a golfer may wish to be able to adjust the angle between the golf club shaft and the head of the putter. This angle is called the lie of the club, and other golf clubs have been used which have an adjustable lie. Typical among putters with an adjustable lie is a frictional adjustment means. With a frictional adjustment means, an infinite number of positions can be chosen which determine the angle between the shaft and the putter head. These can range from perpendicular to horizontal. However, the rules of the United States Golf Association (U.S.G.A.) require that the angle between the putter shaft and the putter head be greater than 10 degrees, and that it be fixed in a positive (non-resistance) manner. Adjustable angled putters which adjust by means of a frictional connection do not meet this requirement.

It is to be pointed out that in regulation golf play, the golfer is prohibited, by current regulations, from changing the configuration of the putter once it has been initiated. However, even with such restriction, a golfer using my present invention will enjoy substantial advantages in that he or she will be able to configure the golf putter to meet the particular course grounds restrictions before regulation play begins. The putter can also be adjusted to account for preferences of different players, so one putter may be configured to the preferences of a another owner or user.

Accordingly, it is an objective of this invention to provide an adjustable lie putter, in which the angle chosen between the putter shaft and the putter head is a rigidly fixed position, but a position which can be changed.

It is an additional object of this invention to provide a way to insure that the angle between the putter shaft and the putter head meets the U.S.G.A. requirement that it be greater than 10 degrees.

It is a further objective of the invention to provide a putter shaft in which the striking face of the putter is adjustable for negative loft, positive loft, mass, and the degree of friction between the striking face and the golf ball.

It is a further objective of the invention to provide a striking surface which is supported at its two ends, but free to flex in its middle.

Additional objects, advantages and novel features of the invention will be set forth in part in the description as follows, and in part will become apparent to those skilled in the art upon examination of the following, or may be learned by practice of the invention. The objects and advantages of the invention may be realized and attained by means of the instrumentalities and combinations particularly pointed out in the appended claims.

DISCLOSURE OF INVENTION

These and other objects are achieved through the use of an adjustable golf putter which has a golf club shaft with a first end for attachment to the putter head and a second end for gripping by the golfer. The golf putter has a putter head body with a front surface, for attachment to the golf club shaft. The golf putter also has a shaft attachment means for attaching the shaft to the putter head body. This means of attachment allows the shaft to be removed from the putter head, and allows the angle between the golf club shaft and the golf club putter head to be adjusted. An array of angle selection notches is provided on the first end of the shaft. These angle selection notches correspond to a variety of angles between the shaft and the putter head body. Choice of an angle selection notch selects an angle between the angle between the putter shaft and the putter head body and holds it at that angle in a positive manner. Also included in the golf putter is a shaft angle selection tooth. This tooth engages an angle selection notch and positions the putter head in relation to the putter shaft at the chosen angle.

The golf putter also includes a minimum angle selection guide which provides for a minimum angle between the putter shaft and the putter head. The presence of the minimal angle selection guide prevents the shaft from being at an angle to the putter head at less than that specified by the minimum angle selection guide. One version of the golf putter includes a minimal angle selection guide which prevents the putter shaft from being mounted at an angle of less than 10 degrees to the putter head.

Another embodiment of the golf putter can also include a face plate assembly which can be attached to and removed from the front surface of the putter head body. This version of the golf putter includes a means for attaching the face plate assembly to the putter head body. The face plate assembly can optionally include a metal plate which is encased within and bonded to an encasement of resilient material, such as rubber. The resilient material can present a striking surface for contact with the golf ball. The face plate can be held a distance away from the golf putter head body. The encased metal plate can be chosen for its characteristic of mass. The golf putter with a face plate assembly can have a striking surface of a preselected loft angle, either positive or negative.

In another embodiment of the golf putter, the golf putter includes a golf club shaft, with a first end for connection to a putter head body and a second end for gripping by the golfer. It also includes a putter head body for attachment to the golf club shaft. The putter head body has a front surface for attachment to a face plate assembly. The golf putter also includes a way of attaching the shaft to the putter head so that the shaft is removable and the manner of attachment allows an adjustable angle of engagement. This allows the angle of engagement of the shaft from the putter head body to be adjusted. In this manner, the lie of the club can be adjusted.

This golf putter also has an array of angle selection notches which correspond to a variety of angles between the shaft and the putter head body. These angle selection notches interact with a shaft angle selection tooth, to allow for the positive and incremental selection and setting of the angle between the golf club shaft and the putter head body. This golf putter also includes a minimum angle selection guide which prevents the putter shaft from being mounted at an angle less than a selected minimum angle to the putter head. This golf putter also includes a face plate assembly which can be selected for its mass and for the loft angle of its striking surface. The face plate assembly can be removed from the putter and exchanged for a face plate assembly with different characteristics of mass and loft angle. The face plate assembly also has a means of removing and attaching the face plate assembly putter head body.

The face plate assembly can include a metal plate which is encased within and bonded to an encasement of resilient material. The face plate is held at a distance from the front surface of the putter head body. This golf putter will typically have a minimum angle selection guide, which is designed to prevent the golf putter from being configured with the golf putter shaft at an angle of less than 10 degrees to the putter head body.

Still other objects and advantages of the present invention will become readily apparent to those skilled in this art from the following detailed description wherein I have shown and described only the preferred embodiment of the invention, simply by way of illustration of the best mode contemplated by carrying out my invention. As will be realized, the invention is capable of modification in various obvious respects all without departing from the invention. Accordingly, the drawing and description are to be regarded as illustrative in nature, and not as restrictive.

BEST MODE FOR CARRYING OUT INVENTION

Figure 1:
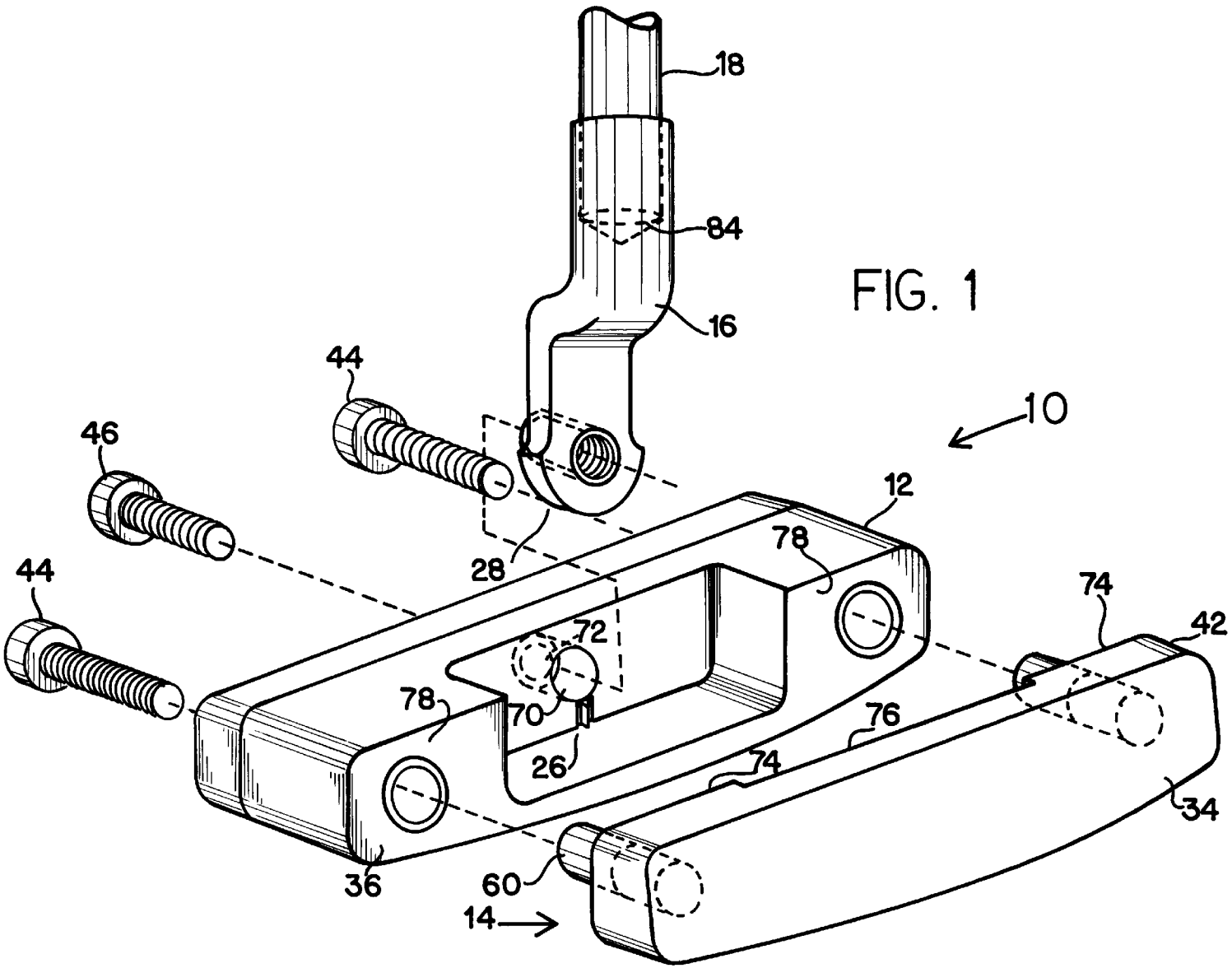
FIG. 1 is a perspective exploded view of the adjustable golf putter.
Figure 2:
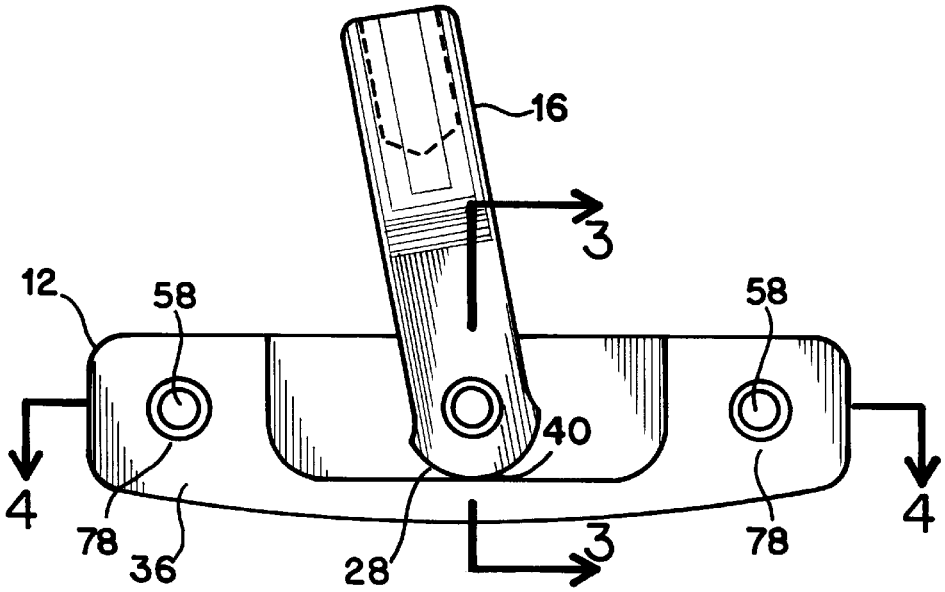
FIG. 2 is a side view of the golf putter with the face plate removed.
Figure 3:
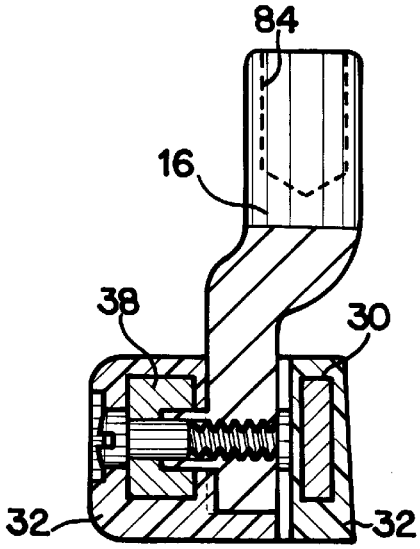
FIG. 3 is an end cross-sectional view through the putter head body and shaft mounting boss.
Figure 4:
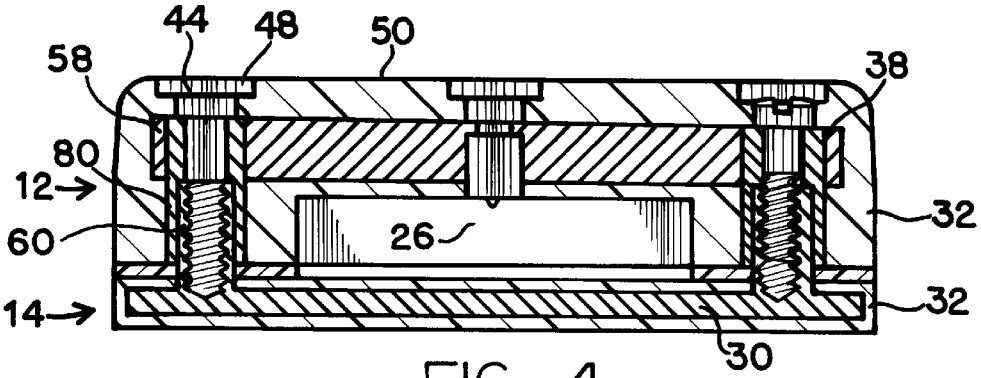
FIG. 4 is a top cross-sectional view through the putter head body with face plate attached.
Figure 5:
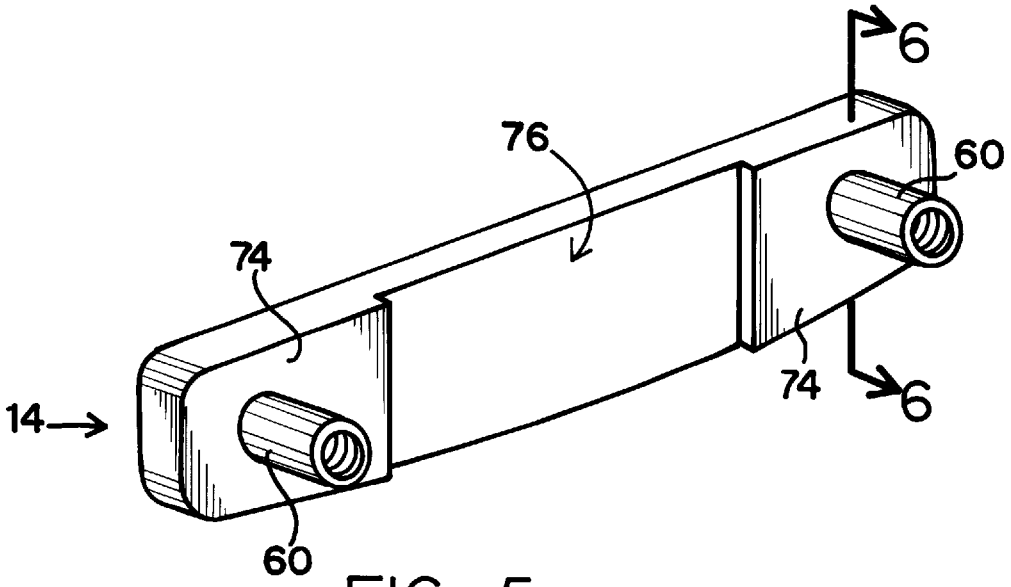
FIG. 5 is a perspective view of the side of the face plate which attaches to the front surface of the putter head body.

Referring to FIGS. 1 through 7, the preferred embodiment of the adjustable golf putter 10 is shown to advantage. As shown in FIG. 1, it is provided with a putter head body 12, a putter shaft 18, a hosel 16, a face plate assembly 14, angle selection notches 28, and angle selection tooth 26. In the preferred embodiment, the shaft 18 can be of different lengths to accommodate golfers of different heights. Alternatively, hosel 16 could be eliminated and shaft 18 attached directly to putter head body 12. As shown in FIG. 1, the golf putter 10 is formed of putter head body 12 which can be either cast or forged, and in the preferred embodiment is formed of a metal plate encased in plastic, to which is attached face plate assembly 14, by means of screws 44 which pass through holes 58 in putter head body 12, and engage the threads of metal bosses 60, as shown in FIG. 4.

Hosel 16 is shown in FIGS. 1, 2, 3 and 7. Hosel 16 has a shaft receiving end with a shaft receiving recess 64. Hosel 16 also has a putter head engagement end with angle selection notches 28, as shown in FIGS. 1 and 2. Putter head engagement end of hosel 16 also has a putter head engagement boss 66, which extends from one side of the hosel. The putter head engagement boss is a cylindrical body which surrounds a threaded hole 68. The hosel can be made of plastic or metal. Depending on the material used for the hosel, the putter head engagement boss can be molded as part of the hosel or can be inserted and fixed in the hosel as a separate piece. Centered among the angle selection notches 28 is a minimum angle selection guide 40, as shown in FIGS. 1 and 2. This guide is a region among the angle selection notches 28 which prevents selection of an angle below a certain minimum angle. In the preferred embodiment of the invention, the minimum angle selection guide 40 occupies a wide enough region in the angle selection notches such that the minimum angle of the putter shaft to the putter head is at ten and one-half degrees.

Formed integral with putter head body 12 is receiver 70 for putter head engagement boss 66. The receiver 70 is designed to allow pivotal, lie adjustable engagement of putter head body 12 to hosel 16 by use of threaded hosel attachment screw 46 which interfits through hosel hole 72 in putter head body 12 and engages with the threaded hole 68 of putter head engagement boss 66.

In the preferred embodiment, the hosel 16 is designed to be adjustable for use by either a left-handed or a right-handed player. To achieve this, angle selection notches 28 are mounted on both sides of the minimum angle selection guide 40. The golf putter can be configured for either right or left-handed players, depending on which group of angle selection notches are engaged with the angle selection tooth.

The angle selection tooth 26 is a projection which in the best mode is generally triangular in cross-section. The base of the triangle is mounted on the putter head body 12, as shown in FIG. 1. The apex of the triangle engages the angle selection tooth 28 chosen by the user. In the preferred embodiment, use of the angle selection notch nearest the minimum angle selection guide results in a shaft to head angle of ten and one-half degrees. Each additional angle selection notch 28 adds seven degrees to the angle. Thus, use of the first, second, third, fourth, etc., angle selection notch 28 results in shaft-to-head angles of ten and one-half degrees, seventeen and one-half degrees, twenty four and one-half degrees and thirty one and one-half degrees respectively.

Figure 6:
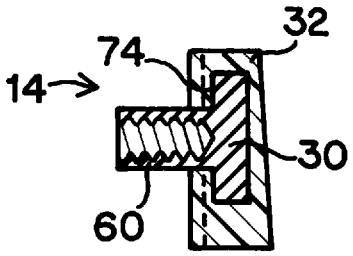
FIG. 6 is a cross-sectional view through the face plate.
Figure 7:
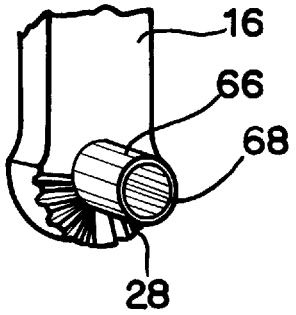
FIG. 7 is a perspective view of the hosel.

Face plate assembly 14 is interchangeable with alternative face plate assemblies to allow for varying degrees of loft, including positive, negative and neutral, varying degrees of mass, and varying and alternate striking surfaces with different frictional characteristics. Face plate assembly 14 can be made of plastic or can also include a metal plate 30 which is encased in a resilient material 32. The resilient material 32 is preferably a plastic. A number of different face plate assemblies can be utilized, each with different loft angles, and if an enclosed metal plate is used, the face plate can have a different thickness and mass for metal plate 30 to adjust the weight of the putter over a range of selectable weight. An embodiment utilizing a metal plate encased in the face plate assembly is shown in FIGS. 3, 4, and 6. In either embodiment, the resilient material 32, is configured to form two engagement surfaces 74, which attach to the front surface 36 of putter head body 12, and a central slot 76 in face plate assembly 14. Central slot 76 allows face plate assembly 14 to flex towards putter head body 12 if a golf ball is struck with sufficient force. This allows face plate assembly 14 to act as a spring, and to impart energy to the golf ball through the rebounding of face plate assembly 14. Control slot 76, since it provides for a degree of separation between much of face plate assembly 14 and putter head body 12, allows minor imperfections in the casting which forms putter head body 12 or in the face plate assembly 14 to not affect the accuracy of the fit between face plate assembly 14 and putter head body 12.

Interconnection and alignment of face plate assembly 14 to putter head body 12 is accomplished by use of threaded bushings 60 which are mounted either in the plastic of the face plate, or in the metal plate 30 of the face plate, and extend through and are surrounded by the encasing resilient material 32. Face plate screws 44 fit into recesses 48 on the rear surface 50 of putter head body 12. The recesses 48 extend to or into metal plate 38 encased in the putter head body 12. Face plate screws 44 rest in the recess 48 on the metal plate 38 and extend through holes therein to engage threaded bushings 60 of the face plate assembly 14. Engagement bushings 80, shown in FIGS. 4, may be attached to metal plate 38 and surround threaded bushings 60 from the face plate assembly 14. As the face plate screws are tightened, engagement surfaces 74 of the face plate assembly 14 are pulled into contact with engagement surfaces 78 on the putter head body. While the preferred embodiment utilizes screws and threaded bushings to attach face plate assembly 14 to putter head body 12, it should be readily apparent to one skilled in the art that other means of attachment are possible and operate within the bounds of this invention. These other means of attachment could include gluing, welding, bonding, brazing and thermal bonding.

Plastic is the preferred material to use as the resilient material 32, and any number of suitable resilient materials can be bonded to metal plates 30 and 38. The resilient material used to cover the striking surface 34 musts be harder than 90 degrees on an A Durometer. The resilient material embedding metal plate 38 may be any hardness, and may be a different material than that used on face plate assembly 14. The resilient material serves two functions; the first to improve the "feel" of the putting stroke, and secondly to provide more control over the golf ball by enabling the golfer to have more control over the initiation of either forward roll or backspin, and to enable the golfer to make minute adjustments in the angle of travel for the golf ball as the golfer follows through with the putting stroke. The choice of the bonded material will include choosing the frictional characteristics of the material over the striking surface 34 of the face plate assembly 14. Resilient materials with increased frictional properties will impart more roll or backspin on the ball than resilient materials which have lower friction.

The shaft to putter head angle is chosen by loosening hosel attachment screw 46 and moving hosel 16 away from putter head body 12. When hosel 16 has moved away from putter head body 12 sufficiently so that angle selection notches 28 no longer engage angle selection tooth 26, but putter head engagement boss 16 still engages receiver 70, then hosel 16 and shaft 18 may be rotated around putter head engagement boss 16 and hosel attachment screw 46. When the desired new angle is achieved, hosel 16 and shaft 18 are moved closer to putter head body 12, so that the chosen angle selection notch 28 engages angle selection tooth 26. Hosel attachment screw 46 is tightened, drawing putter head engagement boss 66 into receiver 70. When hosel attachment screw 46 is fully tightened, putter shaft 18 is at a fixed and discreet angle to putter head body 12, and that angle is insured of being greater than ten and one-half degrees by minimum angle selection guide 40, as shown in FIG. 2.

For purely recreational golf or for practice in preparation for tournament golf played under golfing association rules, it may be desirable for the golfer to use my new adjustable putter 10 to experiment with different configurations such as loft, weight, lie, and friction of the striking surface. However, in tournament play, the rules are that a golf club taken out on to the course during play may not be modifiable or adjustable during the tournament. For that reason, screws 44 and 46 can be countersunk into putter head body 12. In the countersunk configuration, the screws 44 and 46 can be temporarily sealed in place using an epoxy or other type of tamper resistant glue. Once sealed in this way, the putter head is temporarily nonadjustable and can be used for tournament play.

Thus, in the present preferred embodiment, the provision is made for the adjustable golf club to be adjustable within the following parameters; shaft length, putter weight, putter lie (in discreet increments and at positively locked positions, and at an angle greater than a minimum angle), putter loft and striking surface friction, all of which can be adjusted and preset by the golfer, depending upon the course and conditions, before the initiation of regulation play. In addition, the present preferred embodiment of the adjustable putter 10 also provides for improved feel and control of the putter in use.

While there is shown and described the present preferred embodiment of the invention, it is to be distinctly understood that this invention is not limited thereto but may be variously embodied to practice within the scope of the following claims.

I claim:

1. A golf putter which comprises:

a golf club shaft having a first end, for attachment at an angle to a putter head body;

a putter head body with a front surface, for attachment to said golf club shaft;

a shaft attachment means for removably attaching said shaft to said putter head body allowing an adjustable angle of engagement, to adjust the direction of extension of the shaft from the putter head body;

a plurality of angle selection notches on said shaft attachment means which corresponds to a variety of angles between said shaft and said putter head body, for setting the angle between said golf club shaft and said putter head body;

one or more shaft angle selection teeth for engagement with one or more angle selection notches, which select the angle between said shaft and said putter head body, and when said shaft is attached to said putter head body, locks said shaft and said putter head body at a fixed angle; and said shaft attachment means including a minimum angle selection guide centered among said angle selection notches which prevents said putter shaft from being mounted at an angle less than a selected minimum angle.

2. The golf putter of claim 1 in which said minimum angle selection guide prevents said putter shaft from being mounted at an angle of less than 10 degrees.

3. The golf putter of claim 1 which further comprises a face plate assembly for removable attachment to said front surface of said putter head body and means for removably attaching said face plate assembly to said putter head body.

4. The golf putter of claim 1 in which said putter head body comprises a metal plate encased within, and bonded to, resilient material.

5. The golf putter of claim 1 in which said face plate assembly further comprises a metal plate encased within, and bonded to, an encasement of resilient material, said resilient material further having a striking surface and in spaced apart relationship with said front surface of the putter head body.

6. The golf putter of claim 5 wherein the mass of said metal plate encased within said face plate is of a selectable, predetermined mass.

7. The golf putter of claim 5 wherein the striking surface of the resilient material is of a preselectable loft angle.

8. The golf putter of claim 7 wherein the striking surface of the resilient material is of a preselectable positive loft angle.

9. The golf putter of claim 7 wherein the striking surface of the resilient material is of a preselectable negative loft angle.

10. A golf putter which comprises:

a golf club shaft having a first end, for attachment at an angle to a putter head body;

a putter head body with a front surface, for attachment to said golf club shaft;

a shaft attachment means for removably attaching said shaft to said putter head body allowing an adjustable angle of engagement, to adjust the direction of extension of the shaft from the putter head body;

a plurality of angle selection notches on said shaft attachment means which correspond to a variety of angles between said shaft and said putter head body, for setting the angle between said golf club shaft and said putter head body;

one or more shaft angle selection teeth for engagement with a chosen angle selection notch, which select the angle between said shaft and said putter head body, and when said shaft is attached to said putter head body, locks said shaft and said putter head body at a fixed angle;

said shaft attachment means including a minimum angle selection guide centered among said angle selection notches which prevents said putter shaft from being mounted at an angle less than a selected minimum angle; and a face plate assembly for removable attachment to said front surface of said putter head body, said face plate assembly having selectable mass and loft characteristics, and means for removably attaching said face plate assembly to said putter head body; with said front surface of the putter head body.

11. The golf putter of claim 10 in which said minimum angle selection guide prevents said putter shaft from being mounted at an angle of less than 10 degrees.

12. The golf putter of claim 10 in which said putter head body comprises a metal plate encased within, and bonded to, resilient material.

13. The golf putter of claim 10 in which said face plate assembly further comprises a metal plate encased within, and bonded to, an encasement of resilient material, said resilient material further having a striking surface in spaced apart relationship to said front surface of golf putter body.

14. A adjustable golf putter which is assembled from interchangeable parts each of which a golfer can select for his personal preference, which comprises:

a golf club shaft of a length selected by a golfer and having a first end, for attachment at an angle to a putter head body;

an adjustable angle and weight putter head body with a front surface, for attachment to said golf club shaft at a lie angle selected by said golfer;

a shaft attachment means for removably attaching said shaft to said putter head body allowing an adjustable angle of engagement, to adjust the direction of extension of the shaft from the putter head body;

a plurality of angle selection notches on said shaft attachment means which correspond to a variety of angles between said shaft and said putter head body, for setting the angle between said golf club shaft and said putter head body;

one or more shaft angle selection teeth for engagement with a chosen angle selection notch, which select the angle between said shaft and said putter head body, and when said shaft is attached to said putter head body, locks said shaft and said putter head body at a fixed angle;

said shaft attachment means including a minimum angle selection guide centered among said angle selection notches which prevents said putter shaft from being mounted at an angle less than a minimum 10 degree angle;

a face plate assembly for removable attachment to said front surface of said putter head body, said face plate assembly selected from interchangeable face plates of different masses in both positive and negative loft angles, and different face plate material, including metal and metal coated with resilient material; and means for removably attaching said face plate assembly to said putter head body.

* * * * *